US011739982B2

(12) United States Patent
Hazzard et al.

(10) Patent No.: US 11,739,982 B2
(45) **Date of Patent: *Aug. 29, 2023**

(54) CONTROL SYSTEM FOR AN INTERMITTENT PILOT WATER HEATER

(71) Applicant: Ademco Inc., Golden Valley, MN (US)

(72) Inventors: Frederick Hazzard, Plymouth, MN (US); Gregory Young, Blaine, MN (US); Adam Myre, Minnetonka, MN (US); Peter M. Anderson, St. Paul, MN (US); Rolf L. Strand, Crystal, MN (US); John D. Mitchell, Maple Grove, MN (US)

(73) Assignee: Ademco Inc., Golden Valley, MN (US)

( * ) Notice: Subject to any disclaimer, the term of this patent is extended or adjusted under 35 U.S.C. 154(b) by 279 days.

This patent is subject to a terminal disclaimer.

(21) Appl. No.: 16/993,173

(22) Filed: Aug. 13, 2020

(65) Prior Publication Data

US 2021/0048226 A1 Feb. 18, 2021

Related U.S. Application Data

(60) Provisional application No. 62/886,756, filed on Aug. 14, 2019.

(51) Int. Cl.
*F24H 9/20* (2022.01)
*F23N 5/02* (2006.01)
(Continued)

(52) U.S. Cl.
CPC ..... *F24H 9/2035* (2013.01); *F23N 5/022* (2013.01); *F23N 5/102* (2013.01); *F23N 5/203* (2013.01);
(Continued)

(58) Field of Classification Search
CPC ..... F23N 5/022; F23N 5/102; F23N 5/203; F23N 2223/08; F23N 2223/24;
(Continued)

(56) References Cited

U.S. PATENT DOCUMENTS 2,872,972 A 2/1959 Matthews
3,174,535 A 3/1965 Weber
(Continued)

FOREIGN PATENT DOCUMENTS

CN 201688004 U 12/2010
CN 105423567 A 3/2016
(Continued)

OTHER PUBLICATIONS

"A First Proposal to a Protocol of Determination of Boiler Parameters for the Annual Efficiency Method for Donestic Boilers," 2nd edition,18 pages, Jul. 1998.
(Continued)

*Primary Examiner* — Steven B McAllister
*Assistant Examiner* — Benjamin W Johnson
(74) *Attorney, Agent, or Firm* — Greenberg Traurig, LLP; Ryan D. Sharp; David J. Dykeman

(57) ABSTRACT

A water heater control system comprising an energy storage system electrically connected to a pilot valve operator and electrically isolated from a main valve operator. The energy storage system may be electrically connected to an ignition circuit. A thermoelectric device is in thermal communication with the pilot flame and electrically connected to a main valve operator. The water heater system may include a microcontroller configured to establish electrical communications between the device and the energy storage system, the pilot valve operator, and the main valve operator. The microcontroller may be configured to recognize a call for main burner operation, and may also be configured to check
(Continued)

an available voltage of the energy storage system against a setpoint. The microcontroller may establish pilot flame operation with or without main burner operation, depending on whether a call for heat or recharging of the energy storage system is required.

19 Claims, 5 Drawing Sheets

(51) Int. Cl.
*F23N 5/10* (2006.01)
*F23N 5/20* (2006.01)

(52) U.S. Cl.
CPC ..... *F23N 2223/08* (2020.01); *F23N 2227/24* (2020.01); *F23N 2227/30* (2020.01); *F23N 2227/36* (2020.01); *F23N 2235/14* (2020.01); *F23N 2235/18* (2020.01); *F23N 2235/20* (2020.01); *F23N 2235/24* (2020.01)

(58) Field of Classification Search
CPC ..... F23N 2223/30; F23N 2223/36; F23N 2235/14; F23N 2235/18; F23N 2235/20; F23N 2235/24; F24H 9/2035
USPC ..... 122/14.2
See application file for complete search history.

(56) References Cited

U.S. PATENT DOCUMENTS 3,425,780 A 2/1969 Potts
3,520,645 A 7/1970 Cotton et al.
3,574,496 A 4/1971 Hewitt
3,649,156 A 3/1972 Conner
3,681,001 A 8/1972 Potts
3,734,676 A 5/1973 Wyland
3,836,857 A 9/1974 Ikemgami et al.
3,877,864 A 4/1975 Carlson
3,887,325 A 6/1975 Finger et al.
3,909,816 A 9/1975 Teeters
4,033,711 A 7/1977 Christian et al.
4,131,413 A 12/1978 Ryno
4,157,506 A 6/1979 Spencer
4,221,557 A 9/1980 Jalics
4,242,079 A 12/1980 Matthews
4,280,184 A 7/1981 Weiner et al.
4,303,385 A 12/1981 Rudich, Jr. et al.
4,370,557 A 1/1983 Axmark et al.
4,450,499 A 5/1984 Sorelle
4,457,692 A 7/1984 Erdman
4,483,672 A 11/1984 Wallace et al.
4,510,890 A 4/1985 Cowan
4,518,345 A 5/1985 Mueller et al.
4,521,825 A 6/1985 Crawford
4,527,247 A 7/1985 Kaiser et al.
4,555,800 A 11/1985 Nishikawa et al.
4,622,005 A 11/1986 Kuroda
4,655,705 A 4/1987 Shute et al.
4,672,324 A 6/1987 Van Kampen
4,695,246 A 9/1987 Beilfuss et al.
4,709,155 A 11/1987 Yamaguchi et al.
4,770,629 A 9/1988 Bohan, Jr.
4,777,607 A 10/1988 Maury et al.
4,778,378 A 10/1988 Dolnick et al.
4,830,601 A 5/1989 Dahlander et al.
4,842,510 A 6/1989 Grunden et al.
4,843,084 A 6/1989 Parker et al.
4,904,986 A 2/1990 Pinckaers
4,906,177 A 3/1990 Newberry et al.
4,906,178 A 3/1990 Goldstein et al.
4,949,355 A 8/1990 Dyke et al.
4,984,981 A 1/1991 Pottebaum
5,026,270 A 6/1991 Adams et al.
5,026,272 A 6/1991 Takahashi et al.
5,035,607 A 7/1991 Peterson
5,037,291 A 8/1991 Clark
5,073,769 A 12/1991 Kompelien
5,077,550 A 12/1991 Cormier
5,090,895 A 2/1992 Jensen et al.
5,112,217 A 5/1992 Ripka et al.
5,126,721 A 6/1992 Butcher et al.
5,157,447 A 10/1992 Farnand et al.
5,174,743 A 12/1992 Wellman et al.
5,175,439 A 12/1992 Harer et al.
5,180,301 A 1/1993 Gross
5,222,888 A 6/1993 Jones et al.
5,236,328 A 8/1993 Tate et al.
5,251,815 A 10/1993 Foye
5,255,179 A 10/1993 Zekan et al.
5,261,609 A 11/1993 Roth
5,276,630 A 1/1994 Baldwin et al.
5,280,802 A 1/1994 Comuzie, Jr.
5,300,836 A 4/1994 Cha
5,346,391 A 9/1994 Fulleman et al.
5,365,223 A 11/1994 Sigafus
5,368,230 A 11/1994 Oppenberg
5,391,074 A 2/1995 Meeker
5,423,479 A 6/1995 Nichols
5,424,554 A 6/1995 Marran et al.
5,446,677 A 8/1995 Jensen
5,472,336 A 12/1995 Adams et al.
5,506,569 A 4/1996 Rowlette
5,515,297 A 5/1996 Bunting
5,544,645 A 8/1996 Armijo et al.
5,567,143 A 10/1996 Servidio
5,599,180 A 2/1997 Peters et al.
5,636,981 A 6/1997 Lilly
5,682,329 A 10/1997 Seem et al.
5,722,823 A 3/1998 Hodgkiss
5,795,462 A 8/1998 Shurtleff
5,797,358 A 8/1998 Brandt et al.
5,899,684 A 5/1999 McCoy et al.
5,921,470 A 7/1999 Kamath
5,931,655 A 8/1999 Maher, Jr.
5,971,745 A 10/1999 Bassett et al.
6,004,127 A 12/1999 Heimberg et al.
6,059,195 A 5/2000 Adams et al.
6,060,719 A 5/2000 DiTucci et al.
6,071,114 A 6/2000 Cusack et al.
6,084,518 A 7/2000 Jamieson
6,089,856 A 7/2000 Wolcott et al.
6,092,738 A 7/2000 Becker
6,099,295 A 8/2000 McCoy et al.
6,129,284 A 10/2000 Adams et al.
6,135,366 A 10/2000 Bodelin et al.
6,222,719 B1 4/2001 Kadah
6,236,321 B1 5/2001 Trrost, IV
6,257,871 B1 7/2001 Weiss et al.
6,260,773 B1 7/2001 Kamath
6,261,086 B1 7/2001 Fu
6,261,087 B1 7/2001 Bird et al.
6,295,951 B1 10/2001 Valcic et al.
6,299,433 B1 10/2001 Gauba et al.
6,346,712 B1 2/2002 Popovic et al.
6,349,156 B1 2/2002 O'Brien et al.
6,356,827 B1 3/2002 Davis et al.
6,385,510 B1 5/2002 Hoog et al.
6,457,692 B1 10/2002 Gohl, Jr.
6,474,979 B1 11/2002 Rippelmeyer
6,478,573 B1 11/2002 Chian
6,486,486 B1 11/2002 Haupenthal
6,509,838 B1 1/2003 Payne et al.
6,552,865 B2 4/2003 Cyrusian
6,560,409 B2 5/2003 Troost, IV
6,561,792 B1 5/2003 Pfund
6,676,404 B2 1/2004 Lochschmied
6,684,821 B2 2/2004 Lannes et al.
6,700,495 B2 3/2004 Mindermann et al.
6,701,874 B1 3/2004 Schultz et al.
6,743,010 B2 6/2004 Bridgeman et al.
6,782,345 B1 8/2004 Siegel et al.
6,794,771 B2 9/2004 Orloff

(56) References Cited

U.S. PATENT DOCUMENTS

| | | | |
|---|---|---|---|
| 6,829,123 | B2 | 12/2004 | Legatti et al. |
| 6,862,165 | B2 | 3/2005 | Chian et al. |
| 6,881,055 | B2 | 4/2005 | Bird |
| 6,912,671 | B2 | 6/2005 | Christensen et al. |
| 6,917,888 | B2 | 7/2005 | Loginov et al. |
| 6,920,377 | B2 | 7/2005 | Chian |
| 6,923,640 | B2 | 8/2005 | Canon |
| 6,953,161 | B2 | 10/2005 | Laursen et al. |
| 6,955,301 | B2 | 10/2005 | Munsterhuis et al. |
| 6,959,876 | B2 | 11/2005 | Chian et al. |
| 7,073,524 | B2 | 7/2006 | Chian |
| 7,076,373 | B1 | 7/2006 | Munsterhuis et al. |
| 7,088,137 | B2 | 8/2006 | Behrendt et al. |
| 7,088,253 | B2 | 8/2006 | Grow |
| 7,167,813 | B2 | 1/2007 | Chian et al. |
| 7,170,762 | B2 | 1/2007 | Chian et al. |
| 7,202,794 | B2 | 4/2007 | Huseynov et al. |
| 7,241,135 | B2 | 7/2007 | Munsterhuis et al. |
| 7,252,502 | B2 | 8/2007 | Munsterhuis |
| 7,255,285 | B2 | 8/2007 | Froost et al. |
| 7,274,973 | B2 | 9/2007 | Nichols et al. |
| 7,289,032 | B2 | 10/2007 | Seguin et al. |
| 7,314,370 | B2 | 1/2008 | Chian et al. |
| 7,317,265 | B2 | 1/2008 | Chian et al. |
| 7,327,269 | B2 | 2/2008 | Kiarostami |
| 7,435,081 | B2 | 10/2008 | Munsterhuis |
| 7,604,478 | B2 | 10/2009 | Anderson et al. |
| 7,617,691 | B2 | 11/2009 | Street et al. |
| 7,712,677 | B1 | 5/2010 | Munsterhuis et al. |
| 7,721,972 | B2 | 5/2010 | Bracken et al. |
| 7,728,736 | B2 | 6/2010 | Leeland et al. |
| 7,764,182 | B2 | 7/2010 | Chian et al. |
| 7,768,410 | B2 | 8/2010 | Chian |
| 7,798,107 | B2 | 9/2010 | Chian et al. |
| 7,800,508 | B2 | 9/2010 | Chian et al. |
| 7,804,047 | B2 | 9/2010 | Zak et al. |
| 7,944,678 | B2 | 5/2011 | Kaplan et al. |
| 3,066,508 | A1 | 11/2011 | Nordberg et al. |
| 3,070,482 | A1 | 12/2011 | Fuentes et al. |
| 8,074,892 | B2 | 12/2011 | Bracken et al. |
| 8,085,521 | B2 | 12/2011 | Chian |
| 8,123,517 | B2 | 2/2012 | Peruch |
| 8,165,726 | B2 | 4/2012 | Nordberg et al. |
| 8,177,544 | B2 | 5/2012 | Anderson |
| 8,245,987 | B2 | 8/2012 | Hazzard et al. |
| 8,297,524 | B2 | 10/2012 | Kucera et al. |
| 8,300,381 | B2 | 10/2012 | Chian et al. |
| 8,310,801 | B2 | 11/2012 | McDonald et al. |
| 8,322,312 | B2 | 12/2012 | Strand |
| 8,337,081 | B1 | 12/2012 | Holmberg et al. |
| 8,473,229 | B2 | 6/2013 | Kucera et al. |
| 8,485,138 | B2 | 7/2013 | Leeland |
| 8,512,034 | B2 | 8/2013 | Young et al. |
| 8,523,560 | B2 | 9/2013 | Anderson et al. |
| 8,632,017 | B2 | 1/2014 | Kucera et al. |
| 8,636,502 | B2 | 1/2014 | Anderson |
| 8,636,503 | B2 | 1/2014 | Kasprzyk et al. |
| 8,659,437 | B2 | 2/2014 | Chian |
| 8,770,152 | B2 | 7/2014 | Leeland et al. |
| 8,780,726 | B2 | 7/2014 | Anglin et al. |
| 8,875,557 | B2 | 11/2014 | Chian et al. |
| 8,875,664 | B2 | 11/2014 | Strand |
| 9,249,987 | B2 | 2/2016 | Foster et al. |
| 9,303,869 | B2 | 4/2016 | Kasprzyk et al. |
| 9,388,984 | B2 | 7/2016 | Anderson |
| 9,435,566 | B2 | 9/2016 | Hill et al. |
| 9,494,320 | B2 | 11/2016 | Chian et al. |
| 9,574,793 | B2 | 2/2017 | Furmanek et al. |
| 9,752,990 | B2 | 9/2017 | Chian et al. |
| 10,151,482 | B2 | 12/2018 | Teng et al. |
| 10,208,954 | B2 | 2/2019 | Chian et al. |
| 2002/0099474 | A1 | 7/2002 | Khesin |
| 2003/0222982 | A1 | 12/2003 | Hamdan et al. |
| 2004/0209209 | A1 | 10/2004 | Chodacki et al. |
| 2005/0086341 | A1 | 4/2005 | Enga et al. |
| 2005/0161518 | A1 | 7/2005 | Munsterhuis |
| 2006/0084019 | A1 | 4/2006 | Berg et al. |
| 2007/0143000 | A1 | 6/2007 | Bryant et al. |
| 2010/0075264 | A1 | 3/2010 | Kaplan et al. |
| 2010/0199640 | A1 | 8/2010 | Kodo |
| 2012/0060772 | A1 | 3/2012 | Roy |
| 2013/0040252 | A1 | 2/2013 | Bronson et al. |
| 2014/0165927 | A1 | 6/2014 | Zelepouga et al. |
| 2014/0199640 | A1* | 7/2014 | Chian ..... F23C 9/00 431/71 |
| 2014/0199641 | A1 | 7/2014 | Chian et al. |
| 2015/0276268 | A1* | 10/2015 | Hazzard ..... F23N 5/242 431/15 |
| 2015/0277463 | A1 | 10/2015 | Hazzard et al. |
| 2015/0330664 | A1 | 11/2015 | Furmanek et al. |
| 2015/0340749 | A1 | 11/2015 | Chaudron |
| 2016/0265811 | A1* | 9/2016 | Furmanek ..... F24H 9/2035 |
| 2016/0305827 | A1 | 10/2016 | Heil et al. |
| 2016/0353929 | A1 | 12/2016 | McLemore et al. |
| 2017/0038081 | A1 | 2/2017 | Lai et al. |
| 2017/0115005 | A1 | 4/2017 | Chian et al. |
| 2019/0338987 | A1 | 11/2019 | Young et al. |
| 2020/0025375 | A1 | 1/2020 | Chian et al. |
| 2021/0048223 | A1 | 2/2021 | Anderson et al. |
| 2021/0274963 | A1 | 9/2021 | Ravazzani |

FOREIGN PATENT DOCUMENTS

| | | | |
|---|---|---|---|
| CN | 109519965 | A | 3/2019 |
| EP | 0967440 | A2 | 12/1999 |
| EP | 1039226 | A2 | 9/2000 |
| EP | 1148298 | A1 | 10/2001 |
| GB | 1509704 | A | 5/1978 |
| GB | 2193758 | A | 2/1988 |
| KR | 101852868 | A | 4/2018 |
| WO | 9718417 | A1 | 5/1997 |
| WO | 0171255 | A1 | 9/2001 |
| WO | 2011031263 | A1 | 3/2011 |

OTHER PUBLICATIONS

Aaron and Company, "Aaronews," vol. 27 No. 6, 4 pages, Dec. 2001.

Beckett Residential Burners, "AF/AFG Oil Burner Manual," 24 pages, Aug. 2009.

Dungs, "Automatic Gas Burner Controller for Gas Burners with or without fan," Edition 10.08, 6 pages, downloaded Mar. 25, 2013.

Honeywell, "S4965 Series Combined Valve and Boiler Control Systems," EN2R-9053 0302R3-NE, 16 pages, prior to 2009. retrieved from https://www.abar.it/wp-content/uploads/2018/07/ESYS-S4965-SERIES.pdf Aug. 7, 2020.

Honeywell, "S923F1006 2-Stage Hot Surface Ignition Integrated Furnace Controls, Installation Instructions," 69-1857,20 pages, Mar. 2006.

Honeywell, "SV9410/SV9420; SV9510/SV9520; SV9610/SV9620 Smart Valve System Controls," Installation Instructions, 69-1058-2, 16 pages, Jun. 2003.

Robertshaw, "Control Tips," 3 pages, 150-2163B, Nov. 2010.

Fradeline, "Oil Controls, Service Handbook," 70-3709, 84 pages, prior to Apr. 9, 2010. retrieved from https://customer.resideo.com/resources/Techlit/TechLitDocuments/70-0000s/70-3709.pdf on Aug. 7, 2020.

U.S. Department of Energy Office of Coes and Standards (OCS), "Results and Methodology of the Engineering Analysis for Residential Water Heater Efficiency Standards," 101 pages, Oct. 1998.

Underwriters Laboratories Inc. (UL), "UL 296, Oil Burners," ISBN 1-55989-627-2, 107 pages, Jun. 30, 1994.

Vaswani et al., "Advantages of Pulse Firing in Fuel-Fired Furnaces for Precise Low-Temperature Control," downloaded from: www.steelworld.com/tecmay02.htm, 6 pages, Mar. 25, 2013.

Wu et al., "A Web 2.0-Based Scientific Application Framework," 7 pages, Jan. 22, 2013.

www.playhookey.com, "Series LC Circuits," 5 pages, printed Jun. 15, 2007.

(56) References Cited

OTHER PUBLICATIONS

U.S. Appl. No. 16/987,286, filed Aug. 6, 2020, naming inventors Hazzard et al.
U.S. Appl. No. 62/886,746, filed Aug. 14, 2019, naming inventors Hazzard et al.

* cited by examiner

CONTROL SYSTEM FOR AN INTERMITTENT PILOT WATER HEATER

This application claims the benefit of U.S. Provisional Patent Application Ser. No. 62/886,756 (filed Aug. 14, 2019), which is entitled, "CONTROL SYSTEM FOR AN INTERMITTENT PILOT WATER HEATER" and incorporated by reference herein in its entirety.

TECHNICAL FIELD

The disclosure relates to water heating systems.

BACKGROUND

Tank-type water heating systems which incorporate gas combustion as a heat source typically utilize a pilot flame issuing from a pilot burner to initiate combustion of a main gas flow. Combustion of the main gas flow initiates a flame at a main burner. The main burner flame typically heats a volume of water. A temperature sensing device in thermal communication with the volume of water may provide a temperature to a control system to serve as an indication of when pilot flame and main burner flame may be desired. The control system may initiate operations within the water heater system to initiate the pilot flame and the main burner flame by, for example, energizing valve actuators in order to establish the necessary gas flows to one or more dormant burners.

SUMMARY

In general, the water heater control system disclosed provides for generation of a main burner flame in a manner that guards against initiation of a main gas flow prior to establishment of an active pilot flame, such as in an intermittent pilot system. The intermittent pilot systems typically include various measures to interlock the main gas valve with continued operation of the pilot light, as well as to provide the main gas flow only once a pilot flame has been established. Interlocking the main gas valve with continued operation of the pilot light may mitigate the possibility of a main gas flow initiating prior to establishment of an active pilot flame, in order to avoid discharges of uncombusted fuel into enclosed spaces or other environments. This interlocking is useful in water heater systems, where the main gas flows intended to sustain main burner operations are significantly greater than the smaller pilot gas flows which generate the pilot flame.

In one or more examples of the intermittent pilot system described in this disclosure, the water heater system may not be connected to line voltage (e.g., water heater is not plugged into an electrical outlet). However, the electrical components of the water heater system require voltage and current to operate. In some examples, the intermittent pilot system includes a thermoelectric device (e.g., thermopile) that generates a voltage and current in response to application of a flame, such as the pilot flame.

In systems that rely on thermoelectric devices to provide voltage and current, power savings may be important since there is a practical limit to the amount of voltage and current the thermoelectric device can deliver. This limit may be substantially less than the voltage and current that can be delivered in intermittent pilot systems where the water heater system is connected to line voltage. As described above, ensuring that the main gas valve allows gas to flow to the main burner only once the pilot flame is established may be important for safety purposes.

This disclosure describes example techniques to ensure that the main gas valve allows gas to flow to the main burner only when the pilot flame is established and electrical power is being generated from a thermoelectric device. For instance, in one or more examples, the only way for the main gas valve to open is for the thermoelectric device to generate electrical power. The only way for the thermoelectric device to generate electrical power is if there is at a pilot flame. Hence, in one or more examples, the main gas valve may not open unless at least the pilot flame is established.

In one example, the disclosure includes a water heater comprising a pilot ignition circuit configured to cause a pilot spark ignitor to generate a flame using a first amount of gas flow and a first burner, a thermoelectric device that converts thermal energy from the flame into electrical energy to power components of the water heater, a converter circuit configured to generate voltage and current from the electrical energy generated by the thermoelectric device, an energy storage system, wherein the energy storage system comprises at least one of a rechargeable storage system or a non-rechargeable storage system, wherein the rechargeable storage system is configured to store some portion of the electrical energy generated by the thermoelectric device, a first valve operator coupled to receive an amount of the electrical energy generated by the thermoelectric device when the thermoelectric device is generating the electrical energy and coupled to receive a current from the energy storage system when the thermoelectric device is not generating the electrical energy, wherein the first valve operator controls whether there is the first amount of gas flow to the first burner, and a second valve operator coupled to receive a quantity of the electrical energy generated by the thermoelectric device, wherein the second valve operator controls whether there is a second amount of gas flow to a second burner, wherein the second amount of gas flow is greater than the first amount of gas flow.

In one example, the disclosure includes a water heater system comprising a first valve operator, wherein the first valve operator initiates a first gas flow when energized, an energy storage system coupled to energize the first valve operator, a pilot ignition circuit configured to cause a pilot spark ignitor to generate a pilot flame using the first gas flow, a second valve operator, wherein the second valve operator initiates a second gas flow when energized, wherein the second gas flow is greater than the first gas flow, and wherein the second valve operator cannot be energized from the energy storage system, and a thermoelectric device that converts thermal energy from the pilot flame into electrical energy, the thermoelectric device coupled to provide a first portion of the electrical energy to energize the second valve operator and the thermoelectric device coupled to provide a second portion of the electrical energy to the energy storage system.

In one example, the disclosure includes a method of generating a main burner flame, the method comprising initiating a first gas flow using a first valve operator configured to initiate the first gas flow when energized by energizing the first valve operator using an energy storage system coupled to the first valve operator, thereby initiating the first gas flow, prompting a pilot ignition circuit to cause a pilot spark ignitor in thermal communication with the first gas flow to generate ignition energy, thereby generating a pilot flame, allowing a thermoelectric device in thermal communication with the pilot flame to convert thermal energy from the pilot flame to electrical energy, initiating a second gas flow using a second valve operator configured to initiate the second gas flow when energized by energizing the second valve operator using a first portion of the electrical energy, thereby initiating the second gas flow, providing a second portion of the electrical energy to the energy storage system, and directing the second gas flow to a burner configured to establish thermal communication between the second gas flow and the pilot flame, thereby generating the main burner flame.

The details of one or more examples are set forth in the accompanying drawings and the description below. Other features, objects, and advantages will be apparent from the description and drawings, and from the claims.

DETAILED DESCRIPTION

Figure 1:
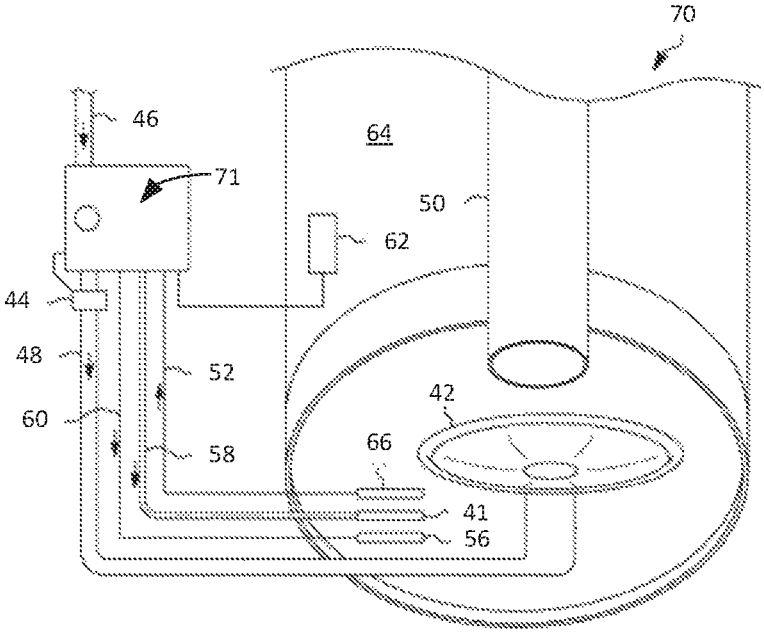
FIG. 1 is a diagram of a pilot light and appliance burner integration in a water heater system.

The water heater control system disclosed herein provides for generation of a main burner flame in a manner that guards against initiation of a main gas flow prior to establishment of an active pilot flame. The system provides this capability to guard against discharges of uncombusted fuel into enclosed spaces or other environments. This may be particularly advantageous in water heater systems, where main gas flows intended to sustain main burner operations are significantly greater than the smaller pilot gas flows which generate the pilot flame.

The water heater control system includes an energy storage system and may operate in the absence of an external power supply, such as a line voltage provided by existing energy infrastructure to a residence or some other structure. The energy storage system may comprise rechargeable energy storage system, non-rechargeable energy storage system, or both. The energy storage system may be electrically connected to a pilot valve operator which controls whether there is a pilot gas flow to a pilot gas burner. For example, energization of the pilot valve operator may cause operation of a servo valve which initiates the pilot gas flow. The energy storage system may additionally be electrically connected to an ignition circuit causing a pilot spark ignitor to generate thermal energy. The pilot spark ignitor may be in close proximity to and/or in thermal communication with the pilot gas flow, initiating a pilot flame at the pilot burner.

A thermoelectric device is in thermal communication with the pilot flame. The thermoelectric device (e.g., a thermopile) converts some portion of the thermal energy received from the pilot flame into electrical energy. In accordance with one or more examples described in this disclosure, the thermoelectric device is electrically connected to a main valve operator, which controls whether there is a main gas flow to a main burner. For example, energization of the main valve operator may cause operation of a servo valve which initiates the main gas flow. The thermoelectric device may also provide power to the energy storage system and the pilot valve operator when the thermoelectric device is generating electrical power.

The main valve operator may be electrically isolated from the energy storage system by, for example, a unidirectional power convertor or some other component. In some examples, the main valve operator may have a high electrical resistance, and the energy storage system may provide electrical power insufficient to operate the main valve operator. This prevents the energy storage system from providing operating power to the main valve operator. The main valve operator which initiates main gas flow may only be sufficiently energized by the thermoelectric device, which only generates sufficient electrical energy once the pilot flame has been established. This safeguards against initiation of a main gas flow prior to establishment of an active pilot flame and avoids discharges of uncombusted fuel into enclosed spaces or other environments.

The water heater control system may include a microcontroller configured to establish electrical communication between the thermoelectric device and the energy storage system, the pilot valve operator, and the main valve operator. The microcontroller may be configured to create and/or initiate a call for main burner operation, and in response, establish the electrical communication. The microcontroller may also be configured to check an available voltage of the energy storage system against a setpoint. Based on the available voltage, the microcontroller may establish pilot flame operation without main burner operation, and allow the thermoelectric device to provide electrical energy to the stored energy system. This may maintain the stored energy system in a condition necessary to initiate the pilot gas flow when called for as well as to power the microcontroller for periodic checks throughout the system. This is particularly advantageous when the water heater control system operates in the absence of an external power supply such as a line voltage provided by a separate infrastructure.

FIG. 1 provides an example water heating system comprising pilot burner 41 and main burner 42 integrated in a water heater system 70. Fuel line 46 is in fluid communication with a main valve 44, which controls fuel flow to a main burner 42. A flue 50 may be an exhaust for main burner 42 in system 70. A pilot valve (not shown) may control fuel flow to a pilot burner 41 through fuel line 58. The pilot valve may be substantially in series or in some other arrangement with main valve 44, and fuel to pilot burner 41 may come from fuel line 46 or some other source There may be a pilot spark ignitor 56, for igniting a pilot gas flow discharging from pilot burner 54.

There may be a thermoelectric device 66 such as a thermopile connected by an electrical line 52 to control system 71. There may be a pilot spark ignitor 56 for igniting a pilot gas flow discharging from pilot burner 41. Pilot spark ignitor 56 may be connected via electrical line 60 to control system 71. Thermoelectric device 66 may be in thermal communication with pilot flame generated at pilot burner 41, and may convert some portion of a heat flux emitted by the pilot flame into electrical energy. A temperature sensing device 62 may be connected to control system 71 and situated in a water tank 64, or otherwise be configured to be in thermal communication with a volume of water in water tank 64. Control system 71 may incorporate a microcontroller configured to establish electrical or data communication with one or more of main valve 44, the pilot valve, and other components.

Control system 71 may include a pilot valve operator configured to actuate the pilot valve of system 70, and may include a main valve operator configured to actuate main valve 44. Control system 71 may also establish an electrical connection between thermoelectric device 66 and the main valve operator, such that the main valve operator can be powered by thermoelectric device 66. Control system 71 may also include an energy storage system in electrical connection with the pilot valve operator.

In an intermittent pilot light system, when main burner 48 operation is called for, an operating sequence in system 70 might initially actuate the pilot valve and establish a pilot flame at pilot burner 41 prior to commencing main valve 44 operations. For example, control system 71 might initially actuate the pilot valve and pilot spark ignitor 56 using an energy storage system in order to establish the pilot flame at pilot burner 41. Subsequently, once the pilot flame is established, the operating sequence might actuate main valve 44 using power delivered by thermoelectric device 66. In this manner, main fuel flow to main burner 48 may be established and the pilot flame may generate combustion of the main fuel flow. A sequence ensuring that the pilot flame is established prior to initiating main fuel flow to the burner avoids situations leading to discharges of uncombusted main fuel into surrounding environments.

Figure 2A:
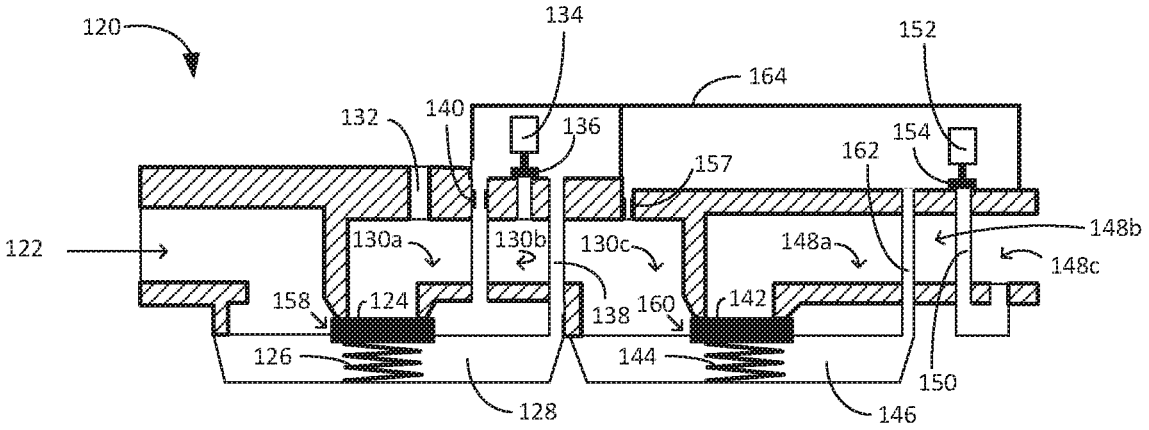
FIG. 2A is an example pilot valve and main valve apparatus with a pilot servo valve and main servo valve in a closed position.
Figure 2B:
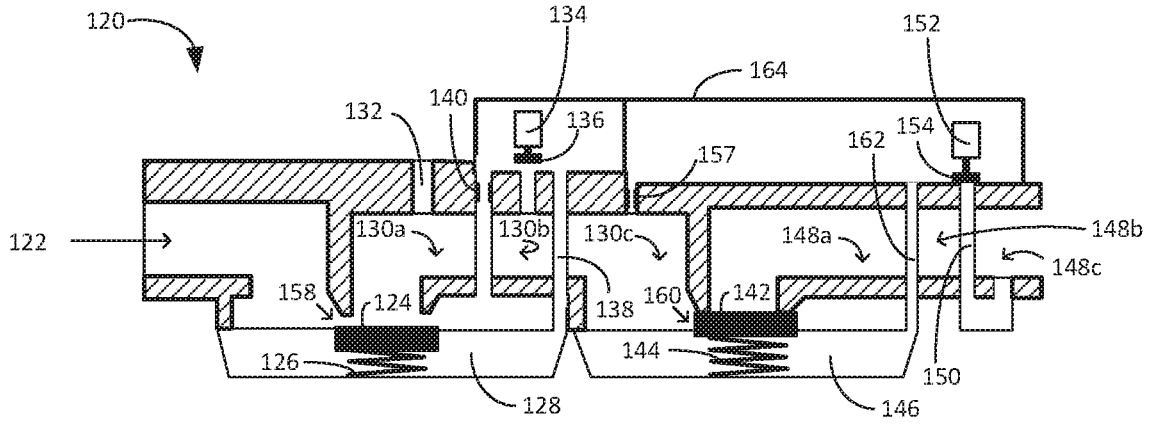
FIG. 2B is the example pilot valve and main valve apparatus with the pilot servo valve in an open position and the main servo valve in a closed position.
Figure 2C:
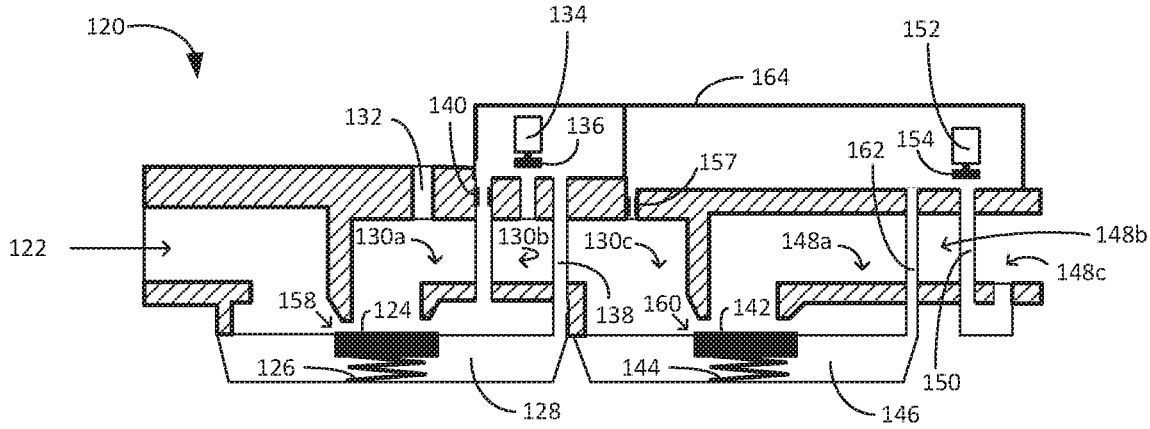
FIG. 2C is an example pilot valve and main valve apparatus with the pilot servo valve and the main servo valve in the open position.

FIGS. 2A-2C illustrates an example pilot valve and main valve configuration. At FIG. 2A, diaphragm 124 is illustrated in a closed position isolating an inlet 122, an intermediate pressure chamber 130, and a pilot outlet 132. Inlet 122 may be in fluid communication with a fuel supply and pilot outlet 132 may be in fluid communication with a pilot burner. Diaphragm 124 in the position illustrated is isolating the fuel supply and the pilot burner, at least at location 158. Diaphragm 124 is acted on by spring member 126, and fluid pressures in inlet 122 and chamber 128 are substantially equal, so that diaphragm 124 is maintained in the closed position. Servo valve 134 is maintaining disc 136 in a position isolating conduit 138 and intermediate pressure chamber 130 (intermediate pressure chamber 130 comprises and extends across 130*a*, 130*b*, and 130*c*), maintaining the fluid pressures in inlet 122 and chamber 128 substantially equal. Additionally, fluid pressures in inlet 122 and chamber 128 are greater than a pressure at intermediate pressure chamber 130 and pilot outlet 132.

Valve body 120 also has diaphragm 142, and servo valve 152 having disc 154. Diaphragm 142 is in a closed position isolating intermediate pressure chamber 130 (comprising 130*a*, 130*b*, and 130*c*) and outlet 148 at least at position 160 (outlet 148 comprises and extends across 148*a*, 148*b*, and 148*c*). Outlet 148 may be in fluid communication with a main burner. Diaphragm 142 is acted on by spring member 144, and diaphragm 124 is maintained in the closed position at least by spring member 144. The pressure of chamber 130 is equalized with outlet 148 through conduit 162.

A pilot valve operator may be configured to cause servo valve 134 to reposition disc 136. In an example, control system 71 may be configured to energize the pilot valve operator using a stored energy system. For example, FIG. 2B illustrates valve body 120 with servo valve 134 having positioned disc 136 to allow fluid communication between chamber 128 and intermediate pressure chamber 130. This provides at least some venting of the pressure in chamber 128 through first supply orifice 140 and reduces the pressure of chamber 128. This allows the pressure of inlet 122 to position diaphragm 124 into the position shown, where fluid communication between inlet 122 and pilot outlet 132 may occur at least at location 158. This allows fluid communication between inlet 122 and pilot outlet 132, and may allow a fuel supply to proceed from inlet 122 to the pilot burner. Additionally, with 152 closed, the pressure of chamber 146 is substantially equalized with intermediate pressure chamber 130 through conduit 162, and diaphragm 142 remains in the closed position.

With fuel supplied to the pilot burner, such as pilot burner 41, an ignitor such as ignitor 56 may establish a pilot flame at pilot burner 41 (FIG. 1). Thermoelectric device 66 in thermal communication with the pilot flame may convert some portion of the heat flux emitted by the pilot flame into electrical energy.

A main valve operator may be configured to cause servo valve 152 to reposition disc 154. In an example, control system 71 may be configured to energize the main valve operator using electrical power from a thermoelectric device such as thermoelectric device 66. For example, FIG. 2C illustrates valve body 120 with servo valve 152 having positioned disc 154 to allow fluid communication between chamber 146 and outlet 148 though conduit 150. This allows at least some venting of the pressure in chamber 146 through second supply orifice 157 and reduces the pressure of chamber 146. The venting of chamber 146 through conduit 150 allows the pressure of intermediate pressure chamber 130 to position diaphragm 142 into the position shown, where fluid communication between intermediate pressure chamber 130 and outlet 148 (comprising 148*a*, 148*b*, and 148*c*) may occur at least at location 160. With servo valve 134 and servo valve 152 both positioned as shown at FIG. 2C, this allows fluid communication between inlet 122 and outlet 148, and may allow a fuel supply to proceed from inlet 122 to a main burner, such as main burner 42 (FIG. 1).

With fuel supplied to the main burner and the pilot flame established, a main flame may be generated at the main burner. In examples where control system 71 uses a stored energy system to energize the pilot valve, and utilizes electrical energy generated through thermal communication with an established pilot flame to energize a main valve, control system 71 provides a safeguard against discharges of uncombusted fuel into enclosed spaces or other environments. This may be particularly advantageous in water heater systems such as water heater system 70, where a main gas flow to main burner 41 is intended to be significantly greater than the pilot gas flow provided to pilot burner 41.

Figure 3:
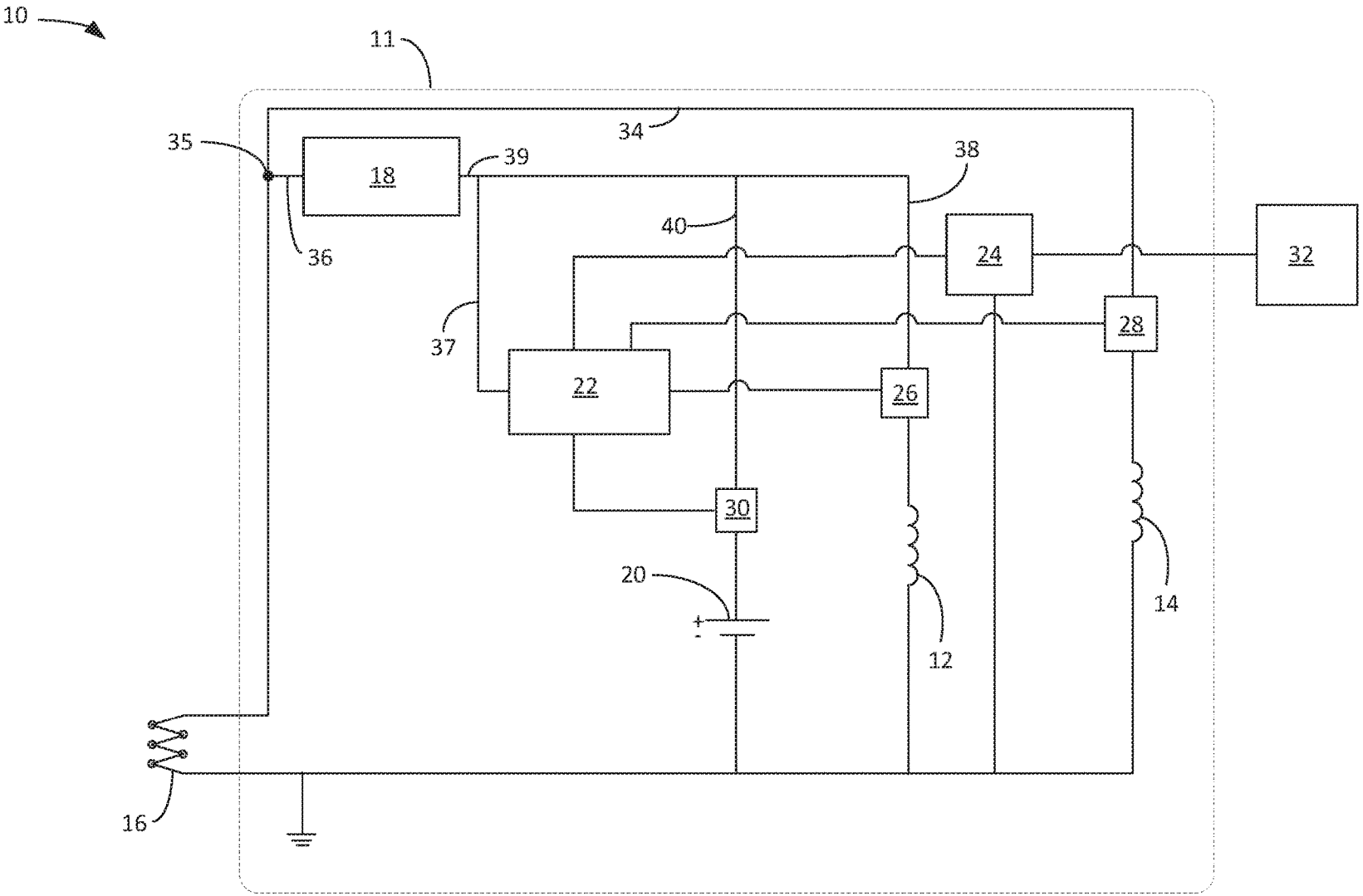
FIG. 3 is an example of a control system for an intermittent pilot water heater.

FIG. 3 illustrates an example water heater control system 10 which may be configured to provide for generation of a main burner flame in a manner that guards against initiation of a main gas flow prior to establishment of an active pilot flame. System 10 may provide advantage in water heater systems such as that depicted at FIG. 1, where main gas flows intended to sustain main burner operations are typically much greater than the smaller pilot gas flows which generate the pilot flame. System 10 may be utilized to guard against potentially large discharges of uncombusted fuel into enclosed spaces or other environments.

System 10 is an electric circuit configured to receive power from a thermoelectric device 16. Thermoelectric device 16 is a component configured to convert thermal energy into electrical power, such as a thermopile. System 10 additionally comprises pilot valve operator 12 and main valve operator 14, as well as convertor 18. As illustrated, thermoelectric device 16 may provide power to main valve operator 14 through electrical line 34, and to convertor 18 through electrical connection 36. Convertor 18 may forward the generated power through electrical line 39 to energy storage system 20 through electrical connection 40, and to pilot valve operator 12 through electrical connection 38. Energy storage system 20 may also provide power to pilot valve operator 12 through electrical connection 40 and electrical connection 38. Energy storage system 20 may thus provide the capability to store some portion of the electrical power generated by thermoelectric device 16, and provide for the powering of pilot valve operator 12 when thermoelectric device 16 is not generating. Energy storage system may power pilot valve operator using a rechargeable and/or non-rechargeable storage components. Energy storage system 20 may also power an ignition circuit 24 using a rechargeable and/or non-rechargeable storage components. For example, thermoelectric device 16 may be configured to be in thermal communication with a heat source intended to operate intermittently, such as an intermittent pilot flame in a water heater, and power from thermoelectric device 16 to pilot valve operator 12 may not always be available. In such cases, energy storage system 20 provides the power to electrical components of system 10. System 10 may further comprise a microcontroller 22. In the example illustrated at FIG. 3, Microcontroller 22 is shown as configured to receive power through electrical line 37 from either convertor 18 or energy storage system 20. However, microcontroller 22 may be additionally or exclusively powered from a power source such as a battery or capacitor. The power source may be a non-rechargeable battery or pre-charged capacitor having a life that lasts as long as a life of the water heater device. System 10 may be contained either wholly or in part within a control module casing 11.

System 10 is configured to limit power flow from node 35 to energy storage system 20 to a single direction, so that while energy storage system 20 may receive power from thermoelectric device 16 through node 35, power flow cannot occur from energy storage system 20 to any components where node 35 is in the electrical path, such as main valve operator 14. In some examples, convertor 18 is a unidirectional device such as a unidirectional DC-DC-convertor which limits power flow from node 35 through electrical line 39 to the single direction. The unidirectional flow of power from node 35 results in an arrangement whereby, when thermoelectric device 16 is receiving thermal energy and generating power, thermoelectric device 16 may deliver power to main valve operator 14 and converter 18, and converter 18 may deliver power to pilot valve operator 12, microcontroller 22, and energy storage system 20. However, when thermoelectric device 16 is not generating electrical power, energy storage system 20 may deliver power to pilot valve operator 12 and microcontroller 22, but not to main valve operator 14. System 10 is thereby configured such that main valve operator 14 can only receive power when thermoelectric device 16 is generating power, whereas pilot valve operator 12 may receive power from thermoelectric device 16 (when thermoelectric device 16 is generating) or energy storage system 20 (when thermoelectric device 16 is not generating).

Using a unidirectional DC-DC convertor for convertor 18 is one example way to ensure that energy storage system 20 does not deliver power to activate main valve operator 14. However, the example techniques are not so limited and other techniques to ensure that energy storage system 20 does not deliver sufficient power may be possible. For example, components such as diodes at lines 36 or 39, switches, etc. may be used to ensure that energy storage system 20 does not provide sufficient power to activate main valve operator 14. Also, the above approaches provide example manners in which to ensure that main valve operator 14 receives sufficient power only from thermoelectric device 16. However, these examples are not intended to be exhaustive, and system 10 may utilize any configuration which allows thermoelectric device 16 to provide sufficient activation power to main valve operator 14 while preventing energy storage system 20 from providing the sufficient activation power.

Figure 4:
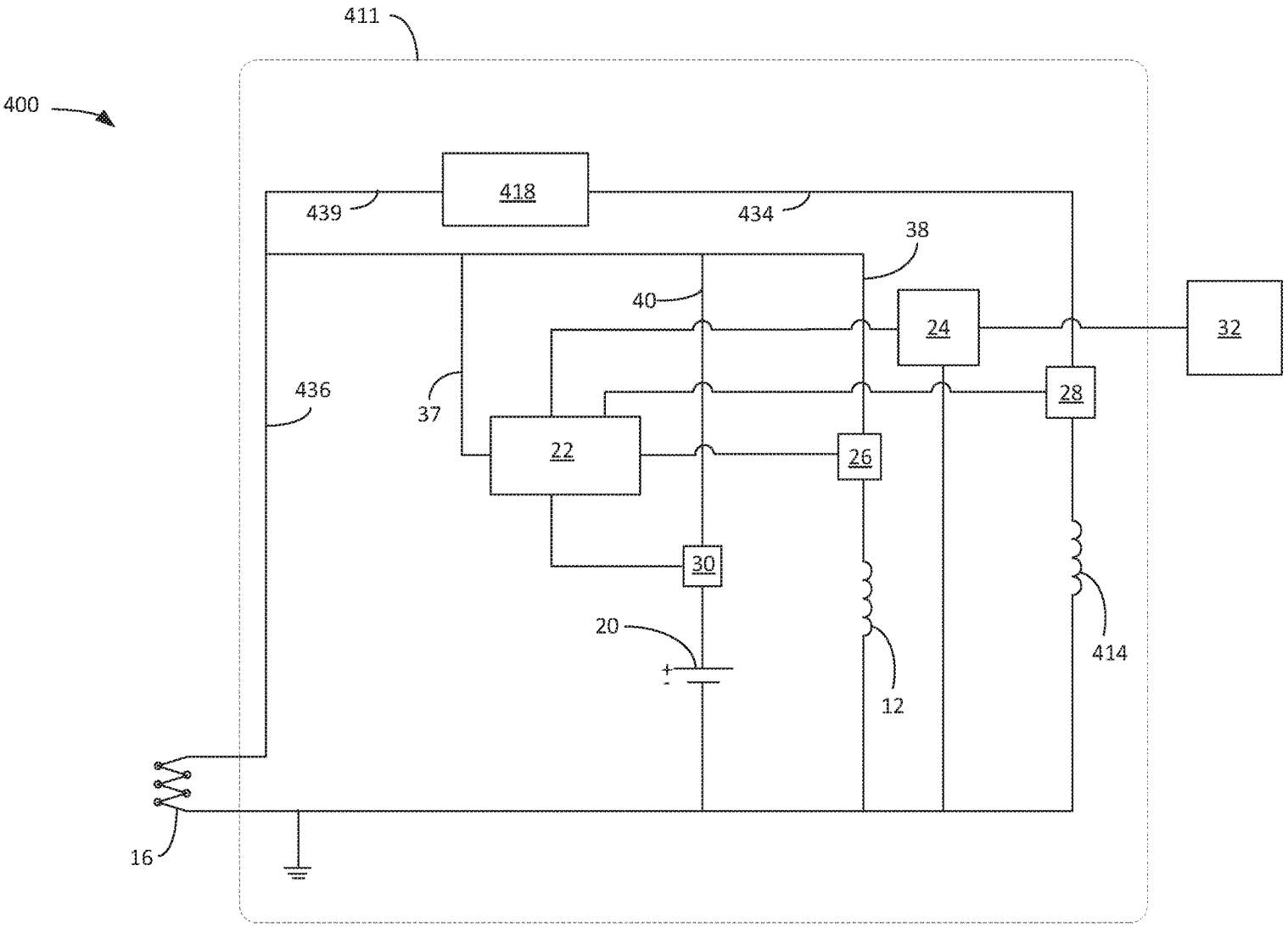
FIG. 4 is a second example of a control system for an intermittent pilot water heater.

FIG. 4 illustrates another example water heater control system 400 which may be configured to provide for generation of a main burner flame in a manner that guards against initiation of a main gas flow prior to establishment of an active pilot flame. System 400 may provide advantage in water heater systems such as that depicted at FIG. 1 and may be utilized to guard against potentially large discharges of uncombusted fuel into enclosed spaces or other environments.

System 400 is configured to receive power from thermoelectric device 16, and comprises pilot valve operator 12 and main valve operator 414. System 400 also comprises convertor 418. Thermoelectric device 16 may provide power to electrical line 436 and microcontroller 22 through electrical connection 37, energy storage system 20 through electrical connection 40, and pilot valve operator 12 through electrical connection 38. Thermoelectric device 16 may provide power to convertor 418 through electrical line 436 and electrical connection 439. Convertor 418 may forward the generated power through electrical line 434 to main valve operator 414. Energy storage system 20 may also provide power to pilot valve operator 12 through electrical connection 40 and electrical connection 38. Energy storage system 20 may also power an ignition circuit 24. System 400 may be contained either wholly or in part within control module casing 411. System 400 may comprise an additional converter between thermoelectric device 16 and microcontroller 22, in order to condition power supplied from thermoelectric device 16 to microcontroller 22. In the example illustrated at FIG. 4, Microcontroller 22 is shown as configured to receive power through electrical line 37 from either thermoelectric device 16 or energy storage system 20. However, microcontroller 22 may be additionally or exclusively powered from a power source such as a battery or capacitor. The battery may be a non-rechargeable battery or pre-charged capacitor having a life that lasts as long as a life of the water heater device.

In system 400, main valve operator 414 is configured to have a high electrical resistance such that main valve operator 414 cannot actuate a valve (such as servo valve 152) when supplied with a voltage typical of the output voltage produced by thermoelectric device 16. The electrical resistance of main valve operator 414 is such that main valve operator 414 may only be sufficiently energized to actuate the necessary valve when thermoelectric device 16 is generating a voltage (i.e., the pilot flame is lit) and converter 418 is stepping up the voltage from the generated level to a level sufficient to cause main valve operator 414 to actuate. This provides an arrangement whereby, when thermoelectric device 16 is receiving thermal energy and generating power, thermoelectric device 16 may deliver power to microcontroller 22, energy storage system 20, pilot valve operator 12, and converter 418, and converter 418 may deliver a stepped up voltage to main valve operator 414. However, when thermoelectric device 16 is not generating electrical power, energy storage system 20 may deliver power and cause operation of pilot valve operator 12 and microcontroller 22, but cannot provide sufficient power to operate main valve operator 14. System 400 is thereby configured such that main valve operator 414 can only operate when thermoelectric device 16 is generating power, whereas pilot valve operator 12 may receive power from thermoelectric device 16 (when thermoelectric device 16 is generating) or energy storage system 20 (when thermoelectric device 16 is not generating).

In an example, thermoelectric device 16 generates a first amount of electrical energy and operation of main valve operator 414 requires a second amount of electrical energy, and the second amount of energy is greater than the first amount of energy. Thermoelectric device 16 may generate the first amount of electrical energy when thermoelectric device 16 is in thermal communication with a pilot flame from a pilot burner, such as pilot burner 41 (FIG. 1). Thermoelectric device 16 may provide the first amount of electrical energy to a converter, and the converter may receive the first amount of electrical energy and provide the second amount of electrical energy to main valve operator 414. Main valve operator 414 may comprise an element or coil configured to provide a resistance such that the first amount of electrical energy is insufficient to cause operation of main valve operator 414.

System 10 and system 400 may provide advantage in an apparatus where a first gas flow sustains a first flame generating a heat flux, and some portion of the heat flux impinges on some portion of a second gas flow in order to generate a second flame. In such devices, it may be advantageous to ensure the first flame is operating before commencing the second gas flow, in order to avoid discharges of uncombusted fuel into enclosed spaces or other environments, or for other reasons. This may be particularly advantageous when the second gas flow is significantly larger than the first gas flow. For example, it may be advantageous in water heater systems where a smaller pilot gas flow sustains a pilot flame at a pilot burner, and the pilot flame is in thermal communication with a larger main gas flow to generate a flame at a main burner. In FIGS. 3 and 4, main valve operator 14 only opens to allow gas flow to the main burner when electrical power (e.g., voltage and current) are generated from thermoelectric device 16. Thermoelectric device 16 may only generate the electrical power in response to the pilot flame. Hence, main valve operator 14 may not open unless the pilot flame is available. For example, when the pilot flame is dormant, thermoelectric device 16 is does not generate sufficient (or any) electrical power. Since there is little to no electric power from thermoelectric device 16, main valve operator 14 remains in a closed state and gas flow cannot be provided to the main burner.

Control system 10 and control system 400 may be utilized in an intermittent pilot light system to effectively ensure that a pilot flame is established prior to initiating main fuel flow to a main burner. Pilot valve operator 12 may be configured to actuate a pilot valve such as the pilot valve of system 70 (FIG. 1), and main valve operator 14 may be configured to actuate a main valve such as main valve 44 (FIG. 1). Thermoelectric device 66 may be configured to be in thermal communication with a pilot flame sustained by a pilot burner 41, such that at least some portion of a heat flux generated by the pilot flame of pilot burner 41 impinges on thermoelectric device 66 (FIG. 1). In other words, thermoelectric device 66 of FIG. 1 is an example thermoelectric device 16 of FIG. 3.

When main burner operation is called for in the intermittent pilot light system, pilot valve operator 12 is in a state such as de-energized where fuel flow through the pilot valve is secured (e.g., blocked), and the pilot flame is dormant. With the pilot flame dormant, thermoelectric device 16 is generating insufficient electrical power to cause valve operation through main valve operator 14. As previously discussed, system 10 is configured so that energy storage system 20 may deliver power to pilot valve operator 12, but not to main valve operator 14 due to, for example, a configuration of convertor 18 or some other component or device in electrical communication with node 35, or a configuration of converter 418. Main valve operator 14 can only receive power from thermoelectric device 16.

System 10 and system 400 may initiate establishment of the dormant pilot flame by energizing pilot valve operator 12 using stored energy system 20 and initiating a pilot gas flow to a pilot burner such as pilot burner 41 (FIG. 1). Energy storage system 20 may energize pilot valve operator using rechargeable energy storage components, non-rechargeable energy storage components, or both. Similarly, system 10 and system 400 may energize ignition circuit 24 to cause pilot spark ignitor 32 to generate thermal energy. Similar to pilot burner 41 and pilot spark ignitor 56 of FIG. 1, pilot spark ignitor 32 may be in thermal communication with the pilot gas flow such that the pilot flame generates. With thermoelectric device 16 in thermal communication with the established pilot flame, thermoelectric device 16 generates electrical energy from the thermal energy of the pilot flame and provides this electrical energy to main valve operator 14. Main valve operator 14 actuates a main valve such as main valve 44 (FIG. 1), providing a main fuel flow to a main burner such as main burner 48 (FIG. 1). The established pilot flame is in thermal communication with the main fuel flow and generates combustion of the main fuel flow.

Acting in this manner, system 10 and system 400 may ensure that a pilot flame is established prior to initiating main fuel flow to a main burner. Ensuring that the pilot flame is established prior to initiating main fuel flow to the burner avoids situations leading to discharges of uncombusted main fuel into surrounding environments.

Further, while main burner operation is required and the pilot flame remains established, system 10 may be configured to allow thermoelectric device 16 to provide power to pilot valve operator 12 through convertor 18, electrical line 39, and electrical connection 38. System 10 may also be configured to allow thermoelectric device 16 to provide power to stored energy system 20 through converter 18, electrical line 39, and electrical connection 40, replenishing the stored energy utilized to initially open the pilot valve. In examples, system 10 may be configured to allow thermoelectric device 16 to provide power to one or more of microcontroller 22, ignition circuit 24, and pilot spark ignitor 32. Additionally, while main burner operation is required and the pilot flame remains established, system 400 may be configured to allow thermoelectric device 16 to provide power to pilot valve operator 12 through electrical line 436 and electrical connection 38. System 400 may also be configured to allow thermoelectric device 16 to provide power to stored energy system 20 through electrical line 436 and electrical connection 40, replenishing the stored energy utilized to initially open the pilot valve. In examples, system 400 may be configured to allow thermoelectric device 16 to provide power to one or more of microcontroller 22, ignition circuit 24, and pilot spark ignitor 32.

Additionally, system 10 and system 400 may be configured such that thermoelectric device 16 is the sole source of power input for one or more of convertor 18 or converter 418, microcontroller 22, energy storage system 20, pilot valve operator 12, main valve operator 14, ignition circuit 24, or pilot spark ignitor 32. This configuration may be advantageous in a water heater system where an additional source of power is unavailable due to, for example, a water heater location removed from a line power source, or some other reason.

In examples, pilot valve operator 12 may operate a pilot servo valve. The pilot servo valve may be configured to control a pressure of a fluid acting on a fluid actuated valve operator, with the fluid valve operator isolating a fuel supply from the pilot burner. When the pilot servo valve acts to increase or decrease a pressure of the fluid, the fluid actuated valve operator may establish fluid communication between the fuel supply and the pilot burner, establishing the pilot gas flow. Similarly, in examples main valve operator 14 may operate a main servo valve. The main servo valve may be configured to control a pressure of a fluid acting on a second fluid actuated valve operator, with the second fluid valve operator isolating a fuel supply from the main burner. When the main servo valve acts to increase or decrease a pressure of the fluid, the fluid actuated valve operator may establish fluid communication between the fuel supply and the main burner, establishing a main gas flow.

For example, Pilot valve operator 12 may be configured to cause operation of servo valve 134 (FIGS. 2A-2C). In examples, pilot valve operator 12 is a component of servo valve 134, such as a solenoid configured to influence the position of a valve stem of servo valve 134, or some other component. Main valve operator 14 may be configured to cause operation of servo valve 152 (FIGS. 2A-2C). In examples, main valve operator 14 is a component of servo valve 152, such as a solenoid configured to influence the position of a valve stem of servo valve 152, or some other component. Pilot valve operator 12 may cause servo valve 134 to reposition and main valve operator 14 may cause servo valve 152 to reposition, initiating the operations within valve body 120 discussed earlier.

In examples, when a flame such as the pilot flame is in thermal communication with a gas flow, or a gas flow is in thermal communication with a flame, this means the flame generates a heat flux and the heat flux impinges on some portion of the gas flow. In examples, the heat flux of the flame is sufficient to generate combustion within the portion of the gas flow. In examples, when the pilot spark ignitor is in thermal communication with a gas flow, this means that when the pilot spark ignitor generates an igniting energy such as a heat flux or electrical discharge, and some portion of the igniting energy impinges on some portion of the gas flow. In examples, the igniting energy of the pilot spark ignitor is sufficient to generate combustion within the portion of the gas flow. In examples, when thermoelectric device 16 is in thermal communication with a flame, the flame generates a heat flux and some portion of the heat flux impinges on some part of thermoelectric device 16. In examples, the heat flux of the flame is sufficient to cause thermoelectric device 16 to convert some portion of the heat flux into electrical energy. In examples, when a temperature sensing device is in thermal communication with a body of water, this means a change in the temperature of the body of water affects the operating behavior of the temperature sensing device.

As discussed, system 10 and system 400 may comprise microcontroller 22. Microcontroller 22 may comprise a processor, memory and input/output (I/O) peripherals. In examples, microcontroller 22 is configured to establish electrical contact between energy storage system 20 and pilot valve operator 12. In an example, a first electronic device 26 is configured to establish electrical contact between energy storage system 20 and pilot valve operator 12, and microcontroller 22 is configured to utilize first electronic device 26 to establish the electrical contact. In some examples, microcontroller 22 is configured to terminate electrical contact between energy storage system 20 and pilot valve operator 12. In an example, first electronic device 26 may be likewise configured to terminate electrical contact between energy storage system 20 and pilot valve operator 12, and microcontroller 22 is configured to utilize first electronic device 26 to terminate the electrical contact.

Microcontroller 22 may be is configured to establish electrical contact between thermoelectric device 16 and main valve operator 14 (FIG. 3) or main valve operator 414 (FIG. 4). In an example, a second electronic device 28 is configured to establish electrical contact between thermoelectric device 16 and main valve operator 14 or main valve operator 414, and microcontroller 22 is configured to utilize second electronic device 28 to establish the electrical contact. In some examples, microcontroller 22 is configured to terminate electrical contact between thermoelectric device 16 and main valve operator 14 or main valve operator 414. In an example, second electronic device 28 is likewise configured to terminate electrical contact between thermoelectric device 16 and main valve operator 14 or main valve operator 414, and microcontroller 22 is configured to utilize second electronic device 28 to terminate the electrical contact.

In some examples, microcontroller 22 is configured to establish electrical contact between convertor 18 and energy storage system 20. In an example, a third electronic device 30 is configured to establish electrical contact between convertor 18 and energy storage system 20, and microcontroller 22 is configured to utilize third electronic device 30 to establish the electrical contact. Microcontroller 22 may be configured to terminate electrical contact between convertor 18 and energy storage system 20. In an example, third electronic device 30 is likewise configured to terminate electrical contact between convertor 18 and energy storage system 20, and microcontroller 22 is configured to utilize third electronic device 30 to terminate the electrical contact.

In some examples, microcontroller 22 is configured to establish electrical contact between thermoelectric device 16 and energy storage system 20. In an example, the third electronic device 30 is configured to establish electrical contact between thermoelectric device 16 and energy storage system 20, and microcontroller 22 is configured to utilize third electronic device 30 to establish the electrical contact. Microcontroller 22 may be configured to terminate electrical contact between thermoelectric device 16 and energy storage system 20. In an example, third electronic device 30 is likewise configured to terminate electrical contact between thermoelectric device 16 and energy storage system 20, and microcontroller 22 is configured to utilize third electronic device 30 to terminate the electrical contact.

First electronic device 26, second electronic device 28, and third electronic device 30 may each be an apparatus sufficient to establish and terminate electrical contact between two portions of an electrical system in response to a signal from microcontroller 22. For example, first electronic device 26, second electronic device 28, and/or third electronic device 30 may comprise a field effect transistor (FET), a relay, a separate switching circuit, or any other device capable of establishing and terminating electrical contact in response to a signal.

In an example, microcontroller 22 is configured to recognize a requirement for main burner operation and in response, establish electrical contact between energy storage system 20 and pilot valve operator 12, and establish electrical contact between thermoelectric device 16 and main valve operator 14 (FIG. 3), or between converter 418 and main valve operator 418 (FIG. 4). In some examples, microcontroller 22 responds by utilizing first electronic device 26 and third electronic device 30 to establish the electrical contact between energy storage system 20 and pilot valve operator 12. Microcontroller 22 may respond by utilizing second electronic device 28 to establish the electrical contact between thermoelectric device 16 and main valve operator 14 (FIG. 3), or between converter 418 and main valve operator 418 (FIG. 4). Microcontroller 22 may be configured to prompt ignition circuit 24 to cause pilot spark ignitor 32 to generate an igniting energy, such as an electrical discharge. Microcontroller 22 may be configured to provide power to the ignition circuit 24 for the igniting energy, or may be configured to provide a control signal to ignition circuit 24 causing ignition circuit 24 to begin accepting power for the igniting energy from energy storage system 20, or some other source. In some examples, microcontroller 22 may receive a signal indicative of a temperature from a temperature sensor such as temperature sensing device 62 (FIG. 1), and microcontroller 22 may recognize the requirement for main burner operation based on the indicative signal. In examples, temperature sensing device 62 may be configured to provide an analog signal indicative of a temperature to an analog-to-digital (A/D) converter, and the A/D converter may provide a digital signal to microcontroller 22.

In an example, microcontroller 22 is similarly programmed to recognize a requirement to secure the main burner, and in response, terminate electrical contact between energy storage system 20 and pilot valve operator 12, and terminate electrical contact between thermoelectric device 16 and main valve operator 14 (FIG. 3) or between converter 418 and main valve operator 414 (FIG. 4). Microcontroller 22 may be configured to alert ignition circuit 24 to cease causing pilot spark ignitor 32 to generate igniting energy.

In some examples, microcontroller 22 is configured to periodically wake and monitor a status of system 10 (FIG. 3) or system 400 (FIG. 4). In some examples, microcontroller 22 is configured to selectively actuate components within system 10 or system 400 in response to a status of energy storage system 20, or another component. For example, microcontroller 22 may be configured to periodically wake and determine an available voltage level in energy storage system 20 by, for example, establishing electrical contact with energy stored system 20 via electrical connection 37, electrical connection 40, and third electronic device 30. Microcontroller 22 may determine if the available voltage is sufficient for the operations leading to establishment of a pilot flame as discussed, or if energy storage system 20 would benefit from reception of additional stored energy from thermoelectric device 16. For example, microcontroller 22 might compare the available voltage to a setpoint, and determine additional energy to energy stored system should or should not occur based on a comparison of the available voltage and the setpoint. If microcontroller 22 determines additional energy to energy storage system is needed, microcontroller 22 may establish electrical contact between pilot valve operator 12 and energy storage system 20, and prompt ignition circuit 24 to cause pilot spark ignitor 32 to generate igniting energy. Microcontroller 22 might utilize first electronic device 26 and third electronic device 30 to establish electrical contact between pilot valve operator 16 and energy storage system 20.

With respect to FIG. 3 and FIG. 4, and as discussed, with the electrical connections established and the pilot spark ignitor initiated, in examples the thermoelectric device 16 begins receiving thermal energy generated by a pilot flame and converting the thermal energy to electrical energy. Microcontroller 22 may allow this electrical power to be provided to energy storage system 20 and pilot valve operator 12.

In examples, one or more of pilot valve operator 12, main valve operator 14, or main valve operator 414 are millivoltage automatic valve operators. In examples, one or more of pilot valve operator 12 or main valve operator 14 are configured to alter the position of a valve when thermoelectric device 16 generates electrical power at a voltage of 800 mV or less (e.g., a voltage in a range of 800 mV to 400 mV). In examples, one or more of pilot valve operator 12 or main valve operator 14 are configured to alter the position of a valve when pilot valve operator 12 or main valve operator 14 receives a current of 50 mA or less (e.g., a current in a range of 25 mA to 50 mA). The electrical resistance of main valve operator 414 is such that main valve operator 414 may only be sufficiently energized to actuate the necessary valve when thermoelectric device 16 is generating a voltage (i.e., the pilot flame is lit) and converter 418 is stepping up the voltage from the generated level to a level sufficient to cause main valve operator 414 to actuate. In examples, converter 418 is configured to generate a voltage greater than that generated by thermoelectric device 16. For example, converter 418 may be configured to generate a voltage in a range of 3 VDC-6 VDC, or some other voltage greater than that produced by thermoelectric device 16. In examples, one or more of pilot valve operator 12, main valve operator 14, or main valve operator 414 cause the opening of a valve when in the energized state. In some examples, one or more of pilot valve operator 12, main valve operator 14, or main valve operator 414 cause the closing of a valve when in the de-energized state. In some examples, one or more of pilot valve operator 12, main valve operator 14, or main valve operator 414 control the energizing of an electromechanical device such as a solenoid valve.

In examples, convertor 18 and convertor 418 may be a power convertor which receives electrical power is a first form and converts the electrical power to another form. Converter 18 and convertor 418 may be an electronic circuit, electronic device, or electromechanical device. In examples, converter 18 receives a first voltage received from thermoelectric device 16 and provides a second voltage to electrical line 39. In examples, converter 418 receives a first voltage received from thermoelectric device 16 and provides a second voltage to electrical line 434. In examples, the second voltage is greater than the first voltage. For example, convertor 18 or convertor 418 might receive a first voltage of about 0.7 VDC (700 mV) from thermoelectric device 16 and provide a voltage of about 3.3 VDC to electrical line 39 or electrical line 434 respectively. In examples, convertor 18 or convertor 418 is a DC step-up convertor.

In examples, thermoelectric device 16 comprises one or more components which generate an output voltage proportional to a local temperature difference or temperature gradient, such as a thermopile, thermocouple, or other thermoelectric generator. Thermoelectric device 16 may comprise a thermoelectric material. Thermoelectric device 16 may comprise a plurality of thermocouples connected in series or in parallel. Thermoelectric device 16 may comprise one or more thermocouple pairs. In examples, a heat flux from a pilot flame generates a temperature gradient, and thermoelectric device 16 generates a DC voltage in response to the temperature gradient.

In examples, energy storage system 20 comprises one or more of a capacitor or a battery. Energy storage system 20 may comprise a supercapacitor. Energy storage system 20 may comprise an electrochemical double-layer capacitor (EDLC). Energy storage system 20 may comprise one or more of a double-layer capacitor, a pseudocapacitor, or a hybrid capacitor. Energy storage system 20 may comprise a lithium battery. In examples, the energy storage system 20 may comprise an energy storage component which may be removed from water heater control system 10 and replaced in water heater control system 10 with a subsequent energy storage component. The energy storage component may be rechargeable such that the energy storage component is configured to have its stored electrical energy restored through a permanent or temporary connection to a power supply, for example thermoelectric device 16 or some other power supply. The energy storage component may be non-rechargeable.

In examples, microcontroller 22 may include any one or more of a microcontroller (MCU), e.g. a computer on a single integrated circuit containing a processor core, memory, and programmable input/output peripherals, a microcontroller (μP), e.g. a central processing unit (CPU) on a single integrated circuit (IC), a controller, a digital signal processor (DSP), an application specific integrated circuit (ASIC), a field-programmable gate array (FPGA), a system on chip (SoC) or equivalent discrete or integrated logic circuitry. A processor may be integrated circuitry, i.e., integrated processing circuitry, and that the integrated processing circuitry may be realized as fixed hardware processing circuitry, programmable processing circuitry and/or a combination of both fixed and programmable processing circuitry.

Figure 5:
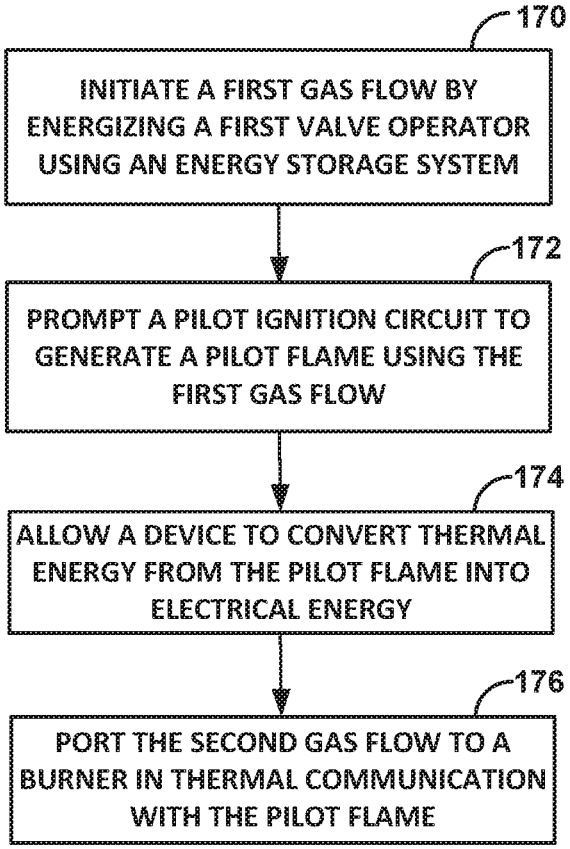
FIG. 5 is a flowchart illustrating an example method for establishing a main burner flame.

Example techniques of generating a main burner flame is illustrated at FIG. 5. The technique may include initiating a first gas flow by energizing a first valve operator using an energy storage system (170). In examples, the technique initiates a pilot gas flow by energizing pilot valve operator 12 using energy storage system 20. The technique may include prompting a pilot ignition circuit to generate a pilot flame using the first gas flow (172). In examples, the technique prompts pilot ignition circuit 24 to cause pilot spark ignitor 32 in thermal communication with the first gas flow to generate a pilot flame.

The technique may include allowing a device to convert thermal energy from the pilot flame into electrical energy (174). In examples, the technique allows thermoelectric device 16 in thermal communication with the pilot flame to generate electrical energy from some portion of the thermal energy received from the pilot flame. The technique may include initiating a second gas flow using a first portion of the electrical energy (176). In examples, the technique initiates a main gas flow by energizing main valve operator 14 using a first portion of the electrical energy. The technique may include storing a second portion of the electrical energy. In examples, the technique provides a second portion of the electrical energy to energy storage system 20.

The technique may include directing the second gas flow to a burner in thermal communication with the pilot flame (168). In examples, the technique ports the main gas flow to main burner 48, which is configured to establish thermal communication between the main gas flow and the pilot flame, thereby generating the main burner flame.

In examples, the technique may include recognizing a temperature signal using a microcontroller, and responding to the temperature signal by utilizing the microcontroller to establish electrical communication between the energy storage system and the first valve operator. The technique may include reacting to the temperature signal by utilizing the microcontroller to prompt the pilot ignition circuit to cause the pilot spark ignitor to generate the pilot flame. In examples, the technique may include acknowledging the temperature signal by utilizing the microcontroller to establish electrical contact between the device and the second valve operator.

In one or more examples, functions described herein may be implemented in hardware, software, firmware, or any combination thereof. For example, the various components and functions of FIGS. 1-5 may be implemented in hardware, software, firmware, or any combination thereof. If implemented in software, the functions may be stored on a tangible computer-readable storage medium and executed by a processor or hardware-based processing unit.

Instructions may be executed by one or more processors, such as one or more DSPs, general purpose microcontrollers, ASICs, FPGAs, or other equivalent integrated or discrete logic circuitry. Accordingly, the term "processor," as used herein, such as may refer to any of the foregoing structure or any other structure suitable for implementation of the techniques described herein. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described.

The present disclosure includes the following examples:

Example 1: A water heater comprising: a pilot ignition circuit configured to cause a pilot spark ignitor to generate a flame using a first amount of gas flow and a first burner; a thermoelectric device that converts thermal energy from the flame into electrical energy to power components of the water heater; a converter circuit configured to generate voltage and current from the electrical energy generated by the thermoelectric device; an energy storage system, wherein the energy storage system comprises at least one of a rechargeable storage system or a non-rechargeable storage system, wherein the rechargeable storage system is configured to store some portion of the electrical energy generated by the thermoelectric device; a first valve operator coupled to receive an amount of the electrical energy generated by the thermoelectric device when the thermoelectric device is generating the electrical energy and coupled to receive a current from the energy storage system when the thermoelectric device is not generating the electrical energy, wherein the first valve operator controls whether there is the first amount of gas flow to the first burner; and a second valve operator coupled to receive a quantity of the electrical energy generated by the thermoelectric device, wherein the second valve operator controls whether there is a second amount of gas flow to a second burner, wherein the second amount of gas flow is greater than the first amount of gas flow.

Example 2: The water heater of claim 1, wherein the water heater is configured to prevent the second valve operator from receiving current from the energy storage system.

Example 3: The water heater of example 1 or 2, wherein the second burner is configured to place the second amount of gas flow in thermal communication with the flame generated by the pilot spark ignitor.

Example 4: The water heater of any of examples 1-3, wherein the thermal energy from the flame is the sole source of energy available to generate the some portion of the electrical energy stored by the energy storage system.

Example 5: The water heater of any of examples 1-4, wherein the pilot spark ignitor is in thermal communication with the first amount of gas flow.

Example 6: The water heater of any of examples 1-5, further comprising a microcontroller wherein: the microcontroller is configured to establish electrical contact between the energy storage system and the first valve operator; the microcontroller is configured to establish electrical contact between the thermoelectric device and the second valve operator; and the microcontroller is configured to: receive a signal indicative of a temperature; establish, in response to the signal indicative of the temperature, electrical contact between the energy storage system and the first valve operator; and initiate, in response to the signal indicative of the temperature, electrical contact between the thermoelectric device and the second valve operator.

Example 7: The water heater of examples 6, further comprising:

a first electronic device configured to establish electrical contact between the energy storage system and the first valve operator; and a second electronic device configured to establish electrical contact between the thermoelectric device and the second valve operator, wherein the microcontroller is configured to utilize the first electronic device to establish electrical contact between the energy storage system and the first valve operator in response to the signal indicative of the temperature, and wherein the microcontroller is configured to utilize the second electronic device to initiate electrical contact between the thermoelectric device and the second valve operator in response to the signal indicative of the temperature.

Example 8: The water heater of example 6 or 7, wherein the microcontroller is configured to prompt the pilot ignition circuit to cause the pilot spark ignitor to generate the flame when the microcontroller receives the signal indicative of the temperature.

Example 9: The water heater of any of examples 6-8, wherein the microcontroller is configured to receive electrical power from at least one of the converter circuit or the energy storage system.

Example 10: The water heater of any of examples 6-9, further comprising a temperature sensing device in thermal communication with a volume of water, wherein the temperature sensing device is configured to provide the signal indicative of the temperature to the microcontroller.

Example 11: The water heater of any of examples 6-10, wherein: the microcontroller is configured to prompt the pilot ignition circuit to cause the pilot spark ignitor to generate the flame; and the microcontroller is configured to: determine an available voltage level in the energy storage system; determine whether the energy storage system requires additional charge based on the available voltage level; establish, based on the energy system requiring additional charge, electrical contact between the energy storage system and the first valve operator; and prompt, based on the energy storage system requiring additional charge, the pilot ignition circuit to cause the pilot spark ignitor to generate the flame.

Example 12: The water heater of any of examples 1-11, wherein the first valve operator is an actuator for a first servo valve and the first servo valve is configured to cause a pilot valve to initiate the first gas flow, and wherein the second valve operator is an actuator for a second servo valve and the second servo valve is configured to cause a main fuel valve to initiate the second gas flow.

Example 13: The water heater of any of examples 1-12, wherein the converter circuit is configured to provide the some portion of the electrical energy generated by the thermoelectric device to the energy storage system and configured to provide the amount of the electrical energy generated by the thermoelectric device to the first valve operator.

Example 14: The water heater of any of examples 1-13, wherein the converter circuit is configured to provide the quantity of the electrical energy generated by the thermoelectric device to the second valve operator.

Example 15: A water heater system comprising: a first valve operator, wherein the first valve operator initiates a first gas flow when energized; an energy storage system coupled to energize the first valve operator; a pilot ignition circuit configured to cause a pilot spark ignitor to generate a pilot flame using the first gas flow; a second valve operator, wherein the second valve operator initiates a second gas flow when energized, wherein the second gas flow is greater than the first gas flow, and wherein the second valve operator cannot be energized from the energy storage system; and a thermoelectric device that converts thermal energy from the pilot flame into electrical energy, the thermoelectric device coupled to provide a first portion of the electrical energy to energize the second valve operator and the thermoelectric device coupled to provide a second portion of the electrical energy to the energy storage system.

Example 16: The water heater of example 15, further comprising a burner configured to establish thermal communication between the second gas flow and the pilot flame to generate a main burner flame.

Example 17: The water heater of example 15 or 16, further comprising a microcontroller wherein: the microcontroller is configured to establish electrical contact between the energy storage system and the first valve operator; the microcontroller is configured to establish electrical contact between the thermoelectric device and the second valve operator; the microcontroller is configured to prompt the pilot ignition circuit to cause the pilot spark ignitor to generate the pilot flame using the first gas flow; and the microcontroller is configured to: receive a signal indicative of a temperature; establish, in response to the signal indicative of the temperature, electrical contact between the energy storage system and the first valve operator; prompt, in response to the signal indicative of the temperature, the pilot ignition circuit to cause the pilot spark ignitor to generate the pilot flame using the first gas flow; and initiate, in response to the signal indicative of the temperature, electrical contact between the thermoelectric device and the second valve operator.

Example 18: The water heater of any of examples 15-17, wherein the microcontroller is configured to: determine an available voltage level in the energy storage system; determine if the energy storage system requires additional charge based on the available voltage; establish, based on the energy system requiring additional charge, electrical contact between the energy storage system and the first valve operator; and prompt, based on the energy system requiring additional charge, the pilot ignition circuit to cause the pilot spark ignitor to generate the pilot flame using the first gas flow.

Example 19: A method of generating a main burner flame, the method comprising: initiating a first gas flow using a first valve operator configured to initiate the first gas flow when energized by energizing the first valve operator using an energy storage system coupled to the first valve operator, thereby initiating the first gas flow; prompting a pilot ignition circuit to cause a pilot spark ignitor in thermal communication with the first gas flow to generate ignition energy, thereby generating a pilot flame; allowing a thermoelectric device in thermal communication with the pilot flame to convert thermal energy from the pilot flame to electrical energy; initiating a second gas flow using a second valve operator configured to initiate the second gas flow when energized by energizing the second valve operator using a first portion of the electrical energy, thereby initiating the second gas flow; providing a second portion of the electrical energy to the energy storage system; and directing the second gas flow to a burner configured to establish thermal communication between the second gas flow and the pilot flame, thereby generating the main burner flame.

Example 20: The method of claim 19, further comprising: receiving a signal indicative of a temperature using a microcontroller; responding to the signal indicative of the temperature by utilizing the microcontroller to establish electrical contact between the energy storage system and the first valve operator, thereby initiating the first gas flow; reacting to the signal indicative of the temperature by utilizing the microcontroller to prompt the pilot ignition circuit to cause the pilot spark ignitor to generate the pilot flame using the first gas flow; thereby generating the pilot flame and acknowledging the signal indicative of the temperature by utilizing the microcontroller to establish electrical contact between the thermoelectric device and the second valve operator, thereby initiating the second gas flow.

Various examples have been described. These and other examples are within the scope of the following claims.

What is claimed is:

1. A water heater comprising:

a pilot ignition circuit configured to cause a pilot spark ignitor to generate a flame using a first amount of gas flow and a first burner;

a thermoelectric device that converts thermal energy from the flame into electrical energy to power components of the water heater;

a converter circuit configured to generate voltage and current from the electrical energy generated by the thermoelectric device;

an energy storage system, wherein the energy storage system comprises at least one of a rechargeable storage system or a non-rechargeable storage system, wherein the rechargeable storage system is configured to store some portion of the electrical energy generated by the thermoelectric device;

a first valve operator coupled to receive an amount of the electrical energy generated by the thermoelectric device when the thermoelectric device is generating the electrical energy and coupled to receive a current from the energy storage system when the thermoelectric device is not generating the electrical energy, wherein the first valve operator controls whether there is the first amount of gas flow to the first burner; and a second valve operator coupled to receive a quantity of the electrical energy generated by the thermoelectric device, wherein the second valve operator controls whether there is a second amount of gas flow to a second burner, wherein the second amount of gas flow is greater than the first amount of gas flow, wherein the quantity of the electrical energy generated by the thermoelectric device is sufficient to activate the second valve operator, wherein the second valve operator is prevented from receiving a quantity of electrical energy from the energy storage system sufficient to activate the second valve operator.

2. The water heater of claim 1, wherein the second burner is configured to place the second amount of gas flow in thermal communication with the flame generated by the pilot spark ignitor.

3. The water heater of claim 1, wherein the thermal energy from the flame is the sole source of energy available to generate the some portion of the electrical energy stored by the energy storage system.

4. The water heater of claim 1, wherein the pilot spark ignitor is in thermal communication with the first amount of gas flow.

5. The water heater of claim 1, further comprising a microcontroller wherein:

the microcontroller is configured to establish electrical contact between the energy storage system and the first valve operator;

the microcontroller is configured to establish electrical contact between the thermoelectric device and the second valve operator; and the microcontroller is configured to:

receive a signal indicative of a temperature;

establish, in response to the signal indicative of the temperature, electrical contact between the energy storage system and the first valve operator; and initiate, in response to the signal indicative of the temperature, electrical contact between the thermoelectric device and the second valve operator.

6. The water heater of claim 5, further comprising:

a first electronic device configured to establish electrical contact between the energy storage system and the first valve operator; and a second electronic device configured to establish electrical contact between the thermoelectric device and the second valve operator, wherein the microcontroller is configured to utilize the first electronic device to establish electrical contact between the energy storage system and the first valve operator in response to the signal indicative of the temperature, and wherein the microcontroller is configured to utilize the second electronic device to initiate electrical contact between the thermoelectric device and the second valve operator in response to the signal indicative of the temperature.

7. The water heater of claim 5, wherein the microcontroller is configured to prompt the pilot ignition circuit to cause the pilot spark ignitor to generate the flame when the microcontroller receives the signal indicative of the temperature.

8. The water heater of claim 5, wherein the microcontroller is configured to receive electrical power from at least one of the converter circuit or the energy storage system.

9. The water heater of claim 5, further comprising a temperature sensing device in thermal communication with a volume of water, wherein the temperature sensing device is configured to provide the signal indicative of the temperature to the microcontroller.

10. The water heater of claim 5, wherein:

the microcontroller is configured to prompt the pilot ignition circuit to cause the pilot spark ignitor to generate the flame; and the microcontroller is configured to:

determine an available voltage level in the energy storage system;

determine whether the energy storage system requires additional charge based on the available voltage level;

establish, based on the energy system requiring additional charge, electrical contact between the energy storage system and the first valve operator; and prompt, based on the energy storage system requiring additional charge, the pilot ignition circuit to cause the pilot spark ignitor to generate the flame.

11. The water heater of claim 1, wherein the first valve operator is an actuator for a first servo valve and the first servo valve is configured to cause a pilot valve to initiate the first gas flow, and wherein the second valve operator is an actuator for a second servo valve and the second servo valve is configured to cause a main fuel valve to initiate the second gas flow.

12. The water heater of claim 1, wherein the converter circuit is configured to provide the some portion of the electrical energy generated by the thermoelectric device to the energy storage system and configured to provide the amount of the electrical energy generated by the thermoelectric device to the first valve operator.

13. The water heater of claim 1, wherein the converter circuit is configured to provide the quantity of the electrical energy generated by the thermoelectric device to the second valve operator.

14. A water heater system comprising:

a first valve operator, wherein the first valve operator initiates a first gas flow when energized;

an energy storage system coupled to energize the first valve operator;

a pilot ignition circuit configured to cause a pilot spark ignitor to generate a pilot flame using the first gas flow;

a second valve operator, wherein the second valve operator initiates a second gas flow when energized, wherein the second gas flow is greater than the first gas flow, and wherein the second valve operator cannot be energized from the energy storage system; and a thermoelectric device that converts thermal energy from the pilot flame into electrical energy, the thermoelectric device coupled to provide a first portion of the electrical energy to energize the second valve operator and the thermoelectric device coupled to provide a second portion of the electrical energy to the energy storage system.

15. The water heater system of claim 14, further comprising a burner configured to establish thermal communication between the second gas flow and the pilot flame to generate a main burner flame.

16. The water heater system of claim 14, further comprising a microcontroller wherein:

the microcontroller is configured to establish electrical contact between the energy storage system and the first valve operator;

the microcontroller is configured to establish electrical contact between the thermoelectric device and the second valve operator;

the microcontroller is configured to prompt the pilot ignition circuit to cause the pilot spark ignitor to generate the pilot flame using the first gas flow; and the microcontroller is configured to:

receive a signal indicative of a temperature;

establish, in response to the signal indicative of the temperature, electrical contact between the energy storage system and the first valve operator;

prompt, in response to the signal indicative of the temperature, the pilot ignition circuit to cause the pilot spark ignitor to generate the pilot flame using the first gas flow; and initiate, in response to the signal indicative of the temperature, electrical contact between the thermoelectric device and the second valve operator.

17. The water heater system of claim 16, wherein the microcontroller is configured to:

determine an available voltage level in the energy storage system;

determine if the energy storage system requires additional charge based on the available voltage;

establish, based on the energy system requiring additional charge, electrical contact between the energy storage system and the first valve operator; and prompt, based on the energy system requiring additional charge, the pilot ignition circuit to cause the pilot spark ignitor to generate the pilot flame using the first gas flow.

18. A method of generating a main burner flame, the method comprising:

initiating a first gas flow using a first valve operator configured to initiate the first gas flow when energized by energizing the first valve operator using an energy storage system coupled to the first valve operator, thereby initiating the first gas flow;

prompting a pilot ignition circuit to cause a pilot spark ignitor in thermal communication with the first gas flow to generate ignition energy, thereby generating a pilot flame;

allowing a thermoelectric device in thermal communication with the pilot flame to convert thermal energy from the pilot flame to electrical energy;

initiating a second gas flow using a second valve operator configured to initiate the second gas flow when energized by energizing the second valve operator using a first portion of the electrical energy, thereby initiating the second gas flow;

providing a second portion of the electrical energy to the energy storage system, wherein the second portion of the electrical energy is prevented from being provided by the energy storage system to the second valve operator; and directing the second gas flow to a burner configured to establish thermal communication between the second gas flow and the pilot flame, thereby generating the main burner flame.

19. The method of claim 18, further comprising:

receiving a signal indicative of a temperature using a microcontroller;

responding to the signal indicative of the temperature by utilizing the microcontroller to establish electrical contact between the energy storage system and the first valve operator, thereby initiating the first gas flow;

reacting to the signal indicative of the temperature by utilizing the microcontroller to prompt the pilot ignition circuit to cause the pilot spark ignitor to generate the pilot flame using the first gas flow;

thereby generating the pilot flame and acknowledging the signal indicative of the temperature by utilizing the microcontroller to establish electrical contact between the thermoelectric device and the second valve operator, thereby initiating the second gas flow.

* * * * *